US011106168B2

(12) United States Patent
Tanto et al.

(10) Patent No.: US 11,106,168 B2
(45) Date of Patent: Aug. 31, 2021

(54) RELEASE SHEET, FIXING UNIT AND MANUFACTURING METHOD OF RELEASE SHEET

(71) Applicant: CANON KABUSHIKI KAISHA, Tokyo (JP)

(72) Inventors: Tomoaki Tanto, Toride (JP); Takeshi Fukuda, Nagareyama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/795,025

(22) Filed: Feb. 19, 2020

(65) Prior Publication Data

US 2020/0272081 A1 Aug. 27, 2020

(30) Foreign Application Priority Data

Feb. 25, 2019 (JP) ..... JP2019-032044

(51) Int. Cl.
*G03G 15/20* (2006.01)

(52) U.S. Cl.
CPC ..... *G03G 15/2064* (2013.01); *G03G 2215/2009* (2013.01); *G03G 2215/2016* (2013.01)

(58) Field of Classification Search
CPC ..... G03G 15/2064; G03G 15/2028; G03G 2215/2009; G03G 2215/2016
See application file for complete search history.

(56) References Cited

U.S. PATENT DOCUMENTS 5,053,830 A * 10/1991 Arai ..... G03G 15/2028 399/323
7,751,768 B2 * 7/2010 Yamada ..... G03G 15/2028 399/323
8,515,312 B2 * 8/2013 Yamada ..... G03G 15/2028 399/122
8,571,455 B2 * 10/2013 Yamada ..... G03G 15/2028 399/323
2003/0016963 A1 * 1/2003 Yoshinaga ..... G03G 15/2046 399/69
2003/0081970 A1 * 5/2003 Yamamoto ..... G03G 15/2028 399/323
2004/0146323 A1 * 7/2004 Fujisawa ..... G03G 15/2028 399/323

(Continued)

FOREIGN PATENT DOCUMENTS

JP 2003263059 A 9/2003

*Primary Examiner* — David J Bolduc
(74) *Attorney, Agent, or Firm* — Rossi, Kimms & McDowell LLP

(57) ABSTRACT

A release sheet includes a support member including a positioning portion formed on a part, in a first direction along a longitudinal direction of the fixing belt, of the support member and configured to position the support member to a holding portion, that holds the fixing belt, in a second direction orthogonal to the first direction, and a release member fixed with the support member and including a front end portion that faces a surface of the fixing belt through a gap. One member among the support member and the release member includes an opening which is oblong in the second direction more than the first direction in order to adjust a distance between the front end portion and the positioning portion in the second direction.

13 Claims, 9 Drawing Sheets

(56) References Cited

U.S. PATENT DOCUMENTS

2008/0260435 A1* 10/2008 Chikugo ..... G03G 15/2032 399/323
2008/0310895 A1* 12/2008 Masuda ..... G03G 15/2064 399/331
2010/0014898 A1* 1/2010 Nakajima ..... G03G 15/2028 399/322
2010/0221047 A1* 9/2010 Nakajima ..... G03G 15/2028 399/323
2010/0303521 A1* 12/2010 Ogawa ..... G03G 15/2028 399/323
2010/0303523 A1* 12/2010 Yamada ..... G03G 15/2028 399/323
2012/0207524 A1* 8/2012 Lee ..... G03G 15/2028 399/323
2012/0243919 A1* 9/2012 Takagi ..... G03G 15/2028 399/323
2012/0308277 A1* 12/2012 Suzuki ..... G03G 15/2028 399/329
2014/0029989 A1* 1/2014 Koda ..... G03G 15/2028 399/323
2014/0086644 A1* 3/2014 Yasuda ..... G03G 15/2028 399/322
2014/0161502 A1* 6/2014 Endo ..... G03G 15/657 399/381
2014/0186074 A1* 7/2014 Ishida ..... G03G 15/2053 399/122
2014/0301751 A1* 10/2014 Takagi ..... G03G 15/2032 399/67
2014/0314455 A1* 10/2014 Matsuyama ..... G03G 15/2028 399/323
2014/0374987 A1* 12/2014 Uehara ..... B65H 5/06 271/264
2015/0030358 A1* 1/2015 Yamakawa ..... G03G 15/2028 399/323
2015/0030359 A1* 1/2015 Ohata ..... G03G 15/2028 399/323
2016/0077474 A1* 3/2016 Watanabe ..... G03G 15/205 399/69
2018/0113405 A1* 4/2018 Yasui ..... G03G 15/2028
2018/0224781 A1* 8/2018 Takahashi ..... G03G 15/2064
2018/0253046 A1* 9/2018 Hamada ..... G03G 15/206
2018/0307165 A1* 10/2018 Murasaki ..... G03G 15/2028
2020/0233354 A1* 7/2020 Tatezawa ..... G03G 15/2064

* cited by examiner

RELEASE SHEET, FIXING UNIT AND MANUFACTURING METHOD OF RELEASE SHEET

BACKGROUND OF THE INVENTION

Field of the Invention

The present invention relates to a release sheet for releasing a recording member from a fixing belt that has fixed a toner image onto the recording member, a fixing unit including such release sheet and a manufacturing method of the release sheet.

Description of the Related Art

Hitherto, there has been known a fixing unit that fixes a toner image onto a recording member and that includes a fixing belt and a release sheet configured to release the recording member from the fixing belt as illustrated in Japanese Patent Application Laid-open No. 2003-263059 for example. Japanese Patent Application Laid-open No. 2003-263059 discloses a configuration of the release sheet which includes a sheet-like release member configured to release the recording member from the fixing belt and a support member for supporting the release member and in which the support member and the release member are joined by laser spot welding.

In a case where the release sheet is composed of the two members of the support member and the release member as described in Japanese Patent Application Laid-open No. 2003-263059, it is required to fix the two members upon appropriately positioning the two members. For instance, the release sheet is disposed such that a front end portion thereof faces a surface of the fixing belt through a gap while positioning a positioning portion of the support member to a holding portion configured to hold the fixing belt. Therefore, it is required to fix the support member with the release member upon accurately positioning a positional relationship of the positioning portion of the support member with the front end portion of the release member.

The release member is fixed with the support member while fixing the release member and the support member to a jig for example. At this time, the release member and the support member are positioned by inserting a shaft provided in the jig to holes provided respectively in the release member and the support member. However, the release member and the support member have component tolerance. Therefore, it is difficult to accurately position the positioning portion of the support member and the front end portion of the release member due to the tolerance of diameter of the holes provided respectively through the release member and the support member and to tolerance of distances among the holes, the front end portion of the release member and the positioning portion of the support member. As a result, the component tolerance as the release sheet becomes large.

SUMMARY OF THE INVENTION

According to a first aspect of the present invention, a release sheet configured to release a recording member from a surface of a fixing belt that fixes a toner image borne on the recording member onto the recording member by heating the toner image includes a support member including a positioning portion formed on a part, in a first direction along a longitudinal direction of the fixing belt, of the support member and configured to position the support member to a holding portion, that holds the fixing belt, in a second direction orthogonal to the first direction, and a release member fixed with the support member and including a front end portion that faces a surface of the fixing belt through a gap. One member among the support member and the release member includes an opening which is oblong in the second direction more than the first direction in order to adjust a distance between the front end portion and the positioning portion in the second direction.

According to a second aspect of the present invention, a manufacturing method of a release sheet configured to release a recording member from a surface of a fixing belt that fixes a toner image borne on the recording member to the recording member by heating the toner image includes preparing a support member and a release member to be fixed with the support member, the support member including a positioning portion formed on a part, in a first direction along a longitudinal direction of the fixing belt, of the support member and configured to position the support member to a holding portion that holds the fixing belt in a second direction orthogonal to the first direction, and a first opening which is oblong in the second direction more than the first direction, the release member including a front end portion that faces a surface of the fixing belt through a gap, and a second opening which is short in the second direction more than the first opening and which is disposed at a position where at least part of the second opening overlaps with the first opening in a state in which the release member is fixed with the support member, installing the support member to a jig such that a shaft is inserted through the first opening, the jig including a shaft positioning the release member in the second direction by being inserted through the second opening, an abutment portion configured to abut with the positioning portion and an urging portion configured to urge the support member in the second direction such that the positioning portion abuts with the abutment portion, installing the release member to the jig on which the support member has been installed such that the shaft is inserted through the second opening, and fixing the release member with the support member in a state in which the positioning portion abuts with the abutment portion by urging the support member by the urging portion.

According to a third aspect of the present invention, a manufacturing method of a release sheet for releasing a recording member from a surface of a fixing belt configured to fix a toner image borne on the recording member to the recording member by heating the toner image includes preparing a support member and a release member to be fixed with the support member, the support member including a positioning portion formed on a part, in a first direction along a longitudinal direction of the fixing belt, of the support member and configured to position the support member to a holding portion that holds the fixing belt in a second direction orthogonal to the first direction, and a fifth opening which is oblong in the second direction more than the first direction, the release member including a front end portion that faces a surface of the fixing belt through a gap, and a sixth opening which is oblong in the second direction more than the first opening at a position where at least part of the sixth opening overlaps with the fifth opening in a state in which the release member is fixed with the support member, preparing a support member including a positioning portion on a part in a first direction along a longitudinal direction of the fixing belt, the positioning portion being configured to position the support member to a holding portion, that holds the fixing belt, in a second direction orthogonal to the first direction, and a release member to be fixed to the support member and including a front end portion that faces a surface of the fixing belt through a gap, the support member including a fifth opening which is oblong in the second direction more than the first direction and the release member including a sixth opening which is oblong in the second direction more than the first opening at a position where at least part of the sixth opening overlaps with the fifth opening in a state in which the release member is fixed with the support member, installing the support member to a jig such that a shaft is inserted through the fifth opening, the jig including the shaft inserted through fifth and sixth openings, a first abutment portion configured to abut with a part of the front end portion, a second abutment portion configured to abut with the positioning portion, a first urging portion configured to urge the release member in the second direction such that part of a front end portion abuts with the first abutment portion and a second urging portion configured to urge the support member in the second direction such that the positioning portion abuts with the abutment portion, installing the release member to the jig on which the support member has been installed such that the shaft is inserted through the sixth opening, and fixing the release member with the support member in a state in which the part of a front end portion abuts with the first abutment portion by urging the release member by the first urging portion and the positioning portion abuts with the second abutment portion by urging the support member by the second urging portion.

Further features of the present invention will become apparent from the following description of exemplary embodiments with reference to the attached drawings.

DESCRIPTION OF THE EMBODIMENTS

First Embodiment

Figure 1:
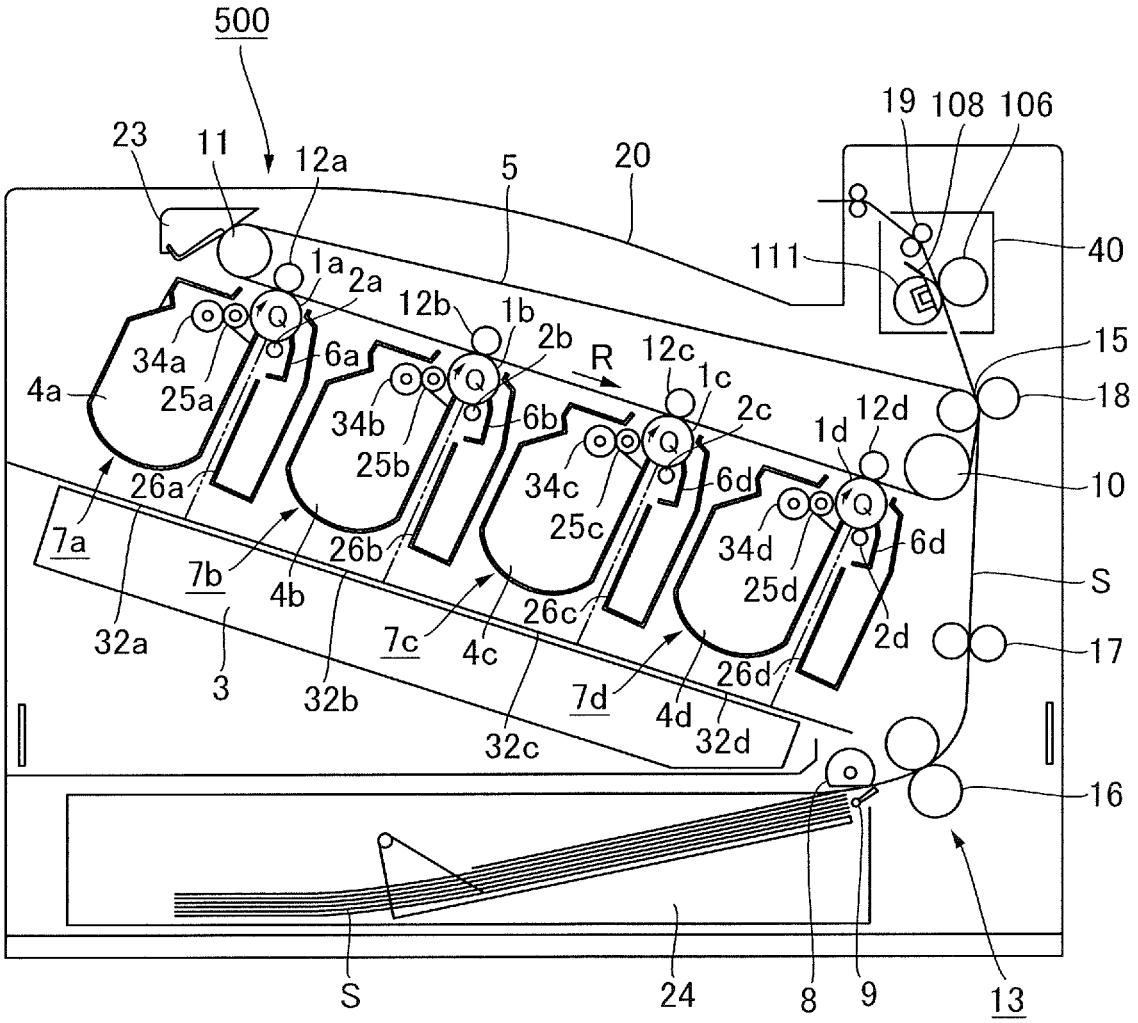
FIG. 1 is a section view illustrating a schematic configuration of an image forming apparatus of a first embodiment.

A first embodiment of the present disclosure will be described with reference to FIGS. 1 through 8B. Firstly, a schematic configuration of an image forming apparatus 500 of the present embodiment will be described with reference to FIG. 1.

Image Forming Apparatus

The image forming apparatus 500 of the present embodiment is an electro-photographic tandem type full-color printer including four cartridges 7*a*, 7*b*, 7*c* and 7*d* each having photosensitive drums 1*a*, 1*b*, 1*c* and 1*d* serving as image bearing members. The image forming apparatus 500 forms a toner image, i.e., an image, on a recording member in response to an image signal transmitted from an image reading apparatus not illustrated and connected to an apparatus body of the image forming apparatus 500 or from a host device such as a personal computer communicably connected to the apparatus body. The recording member is a sheet member such as a sheet of paper, a plastic film and a cloth. The cartridges 7*a*, 7*b*, 7*c* and 7*d* form yellow, magenta, cyan and black toner images, respectively.

The four cartridges 7*a*, 7*b*, 7*c* and 7*d* provided in the image forming apparatus 500 have substantially the same configuration except of that their developing colors are different. Accordingly, the cartridge 7*a* will be typically described here and the other cartridges will be indicated by substituting a subscript "a" of the reference sign "7*a*" into b, c and d, respectively, and their description will be omitted.

The cartridge 7*a* includes a drum unit 26*a*, having a photosensitive drum 1*a* serving as an image bearing member and as an electro-photographic photosensitive member, and a developing unit 4*a*. The photosensitive drum 1*a* is rotationally driven clockwise in a direction of an arrow Q in FIG. 1 by a driving unit not illustrated. Disposed around the photosensitive drum 1*a* are a cleaning member 6*a*, a charging roller 2*a* and a developing unit 4*a* in order of a rotation direction the drum.

The charging roller 2*a* homogeneously charges a surface of the photosensitive drum 1*a*. After charging the surface of the photosensitive drum 1*a* by the charging roller 2*a*, a laser beam is exposed on the surface of the photosensitive drum 1*a* through unit openings 32*a* through 32*d* from a scanner unit 3 serving as an exposure unit. Thereby, an electrostatic latent image is formed on the surface of the photosensitive drum 1*a*. Note that the scanner unit 3 is disposed under the cartridges 7*a* through 7*d* in the present embodiment.

The developing unit 4*a* supplies toner to the electrostatic latent image formed on the photosensitive drum 1*a* to develop the electrostatic latent image as a toner image. The developing unit 4*a* includes a developing roller 25*a* configured to supply the toner to the surface of the photosensitive drum 1*a* and a supply roller 34*a* configured to come into contact with the developing roller 25*a* to supply the toner to the developing roller 25*a*.

In forming an image on a recording member S, the electrostatic latent image formed on the surface of the photosensitive drum 1*a* by the scanner unit 3 is developed as the toner image by the developing unit 4*a* and is then transferred onto an intermediate transfer belt 5.

The intermediate transfer belt 5 serving as an intermediate transfer body is stretched by a driving roller 10, a tension roller 11 and others and is driven in a direction of an arrow R in FIG. 1. Primary transfer rollers 12*a* through 12*d* are arranged on an inner side of the intermediate transfer belt 5 so as to face respectively with the photosensitive drums 1*a* through 1*d* and so that transfer biases are applied thereto by a power source, i.e., a bias applying portion not illustrated. For instance, in a case of using negatively charged toner, the toner images are primarily and sequentially transferred onto the intermediate transfer belt 5 by applying a positive bias to the primary transfer rollers 12*a* through 12*d*. Still further, a secondary transfer roller 18 serving as a secondary transfer member is disposed so as to come into contact with an outer circumferential surface of the intermediate transfer belt 5 downstream of the tension roller 11 in terms of a rotation direction of the intermediate transfer belt 5 to form a secondary transfer portion 15 between the intermediate transfer belt 5 and the secondary transfer roller 18.

The cleaning member 6*a* removes the toner left on the photosensitive drum 1*a* after transferring the toner image which has been formed on the photosensitive drum 1*a* onto the intermediate transfer belt 5. The toner removed by the cleaning member 6*a* is collected into a removed toner chamber within the drum unit 26*a*.

The toner images on the photosensitive drums 1*a* through 1*d* are superimposed and are primarily transferred onto the intermediate transfer belt 5. Then, the four color toner images are conveyed to the secondary transfer portion 15 while being superimposed on the intermediate transfer belt 5. The toner images are secondarily transferred from the intermediate transfer belt 5 to the recording member S at the secondary transfer portion 15. Toner left on the intermediate transfer belt 5 after the secondary transfer to the recording member S is removed by a belt cleaning unit 23, and the removed toner is collected into a disposed toner collecting container not illustrated by passing through a disposed toner conveyance path not illustrated.

Meanwhile, in synchronism with the image forming operation described above, the recording member S is fed toward the secondary transfer portion 15 by a conveyance mechanism composed of a feed unit 13, a registration roller pair 17 and others. The feed unit 13 includes a feed cassette 24 storing a plurality of recording members S, a feed roller 8 feeding the recording member S and a conveyance roller pair 16 conveying the recording member S thus fed.

The feed cassette 24 is configured to be drawable from the apparatus body of the image forming apparatus 500. The recording members S can be replenished by a user who sets the recording members S in the feed cassette 24 after drawing the feed cassette 24 out of the apparatus body and who inserts the feed cassette 24 again into the apparatus body. The feed roller 8 comes into pressure contact with the recording member S located at an uppermost position among the recording members S stored in the feed cassette 24, and as the feed roller 8 rotates, the recording member S is conveyed while being separated one by one by a separation pad 9, i.e., by a friction piece releasing method.

Then, the recording member S conveyed from the feed unit 13 is conveyed by a registration roller pair 17 toward the secondary transfer portion 15. The four color toner image on the intermediate transfer belt 5 can be secondarily transferred onto the recording member S conveyed as described above by applying a positive bias to the secondary transfer roller 18 at the secondary transfer portion 15.

Then, the recording member S fed from the secondary transfer portion 15 is conveyed further toward a fixing unit 40. The fixing unit 40 applies heat and pressure to the toner image borne on the recording member S to fix the toner image on the recording member S. After that, the recording member S on which the toner image has been fixed is discharged to a discharge tray 20 by a discharge roller pair 19.

Fixing Unit

Figure 2:
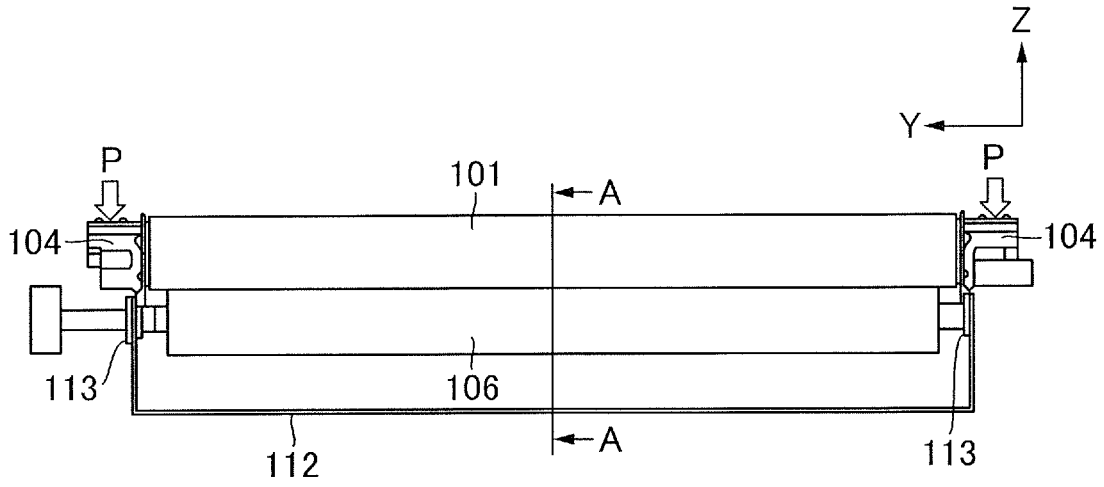
FIG. 2 is a plan view of a fixing unit of the first embodiment.
Figure 3:
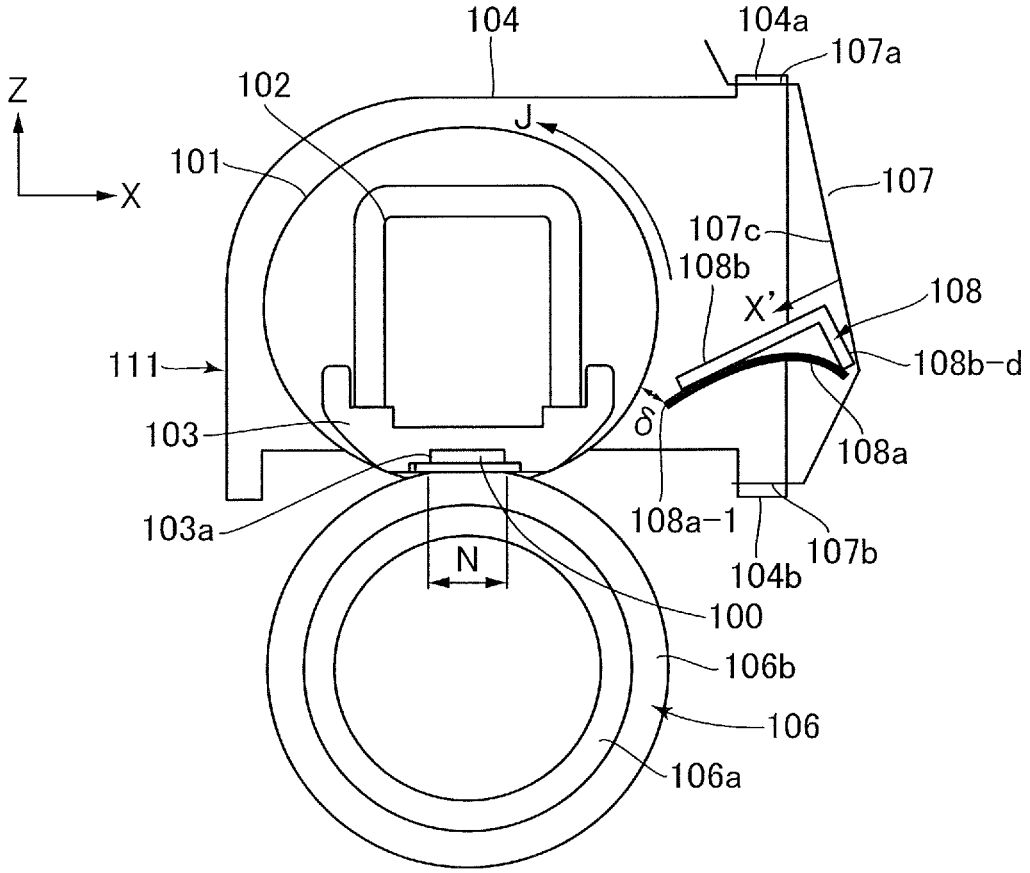
FIG. 3 is a section view taken along a line A-A of FIG. 2.

Next, a configuration of the fixing unit 40 of the present embodiment will be described with reference to FIGS. 2 and 3. The fixing unit 40 is of a film heating method of using a film-like fixing belt 101 in which an elastic layer is formed on a base layer of a cylindrical thin metal, and the fixing unit 40 is of a pressurizing roller driving method in which the fixing belt 101 is driven by a pressurizing roller 106. FIG. 2 is a plan view longitudinally illustrating the fixing unit 40 of the present embodiment and FIG. 3 is a section view laterally illustrating the fixing unit 40.

The fixing unit 40 includes the fixing belt 101, the pressurizing roller 106, a heater 100, a pressure contact member 103, a stay 102, a fixing flange 104, a release sheet 108 and a pressing member 107. The recording member S conveyed to a nip portion N formed between the fixing belt 101 and the pressurizing roller 106 is heated to fix the toner image borne on the recording member S to the recording member S.

What the fixing belt 101, the heater 100, the pressure contact member 103, the stay 102, the fixing flange 104 and the release sheet 108 are brought together will be referred to as a film unit 111 hereinafter. Still further, a short direction of the film unit 111 will be denoted as an X direction, a longitudinal direction of the film unit 111 as a Y direction and a pressurizing direction of the film unit 111 described later as a Z direction in the present embodiment. Note that the longitudinal direction, i.e., a lateral direction in FIG. 3, is a direction intersecting with a conveyance direction of the recording member S conveyed through the nip portion N and is also a width direction intersecting with a rotation direction of the fixing belt 101. Next, configurations of the respective components will be detailed.

Fixing Belt

The fixing belt 101 which is an endless belt serving as a fixing member is a cylindrical heat-resistant film for transmitting heat to the recording member S and is loosely and externally fitted around the pressure contact member 103. In order to reduce thermal capacity and to improve quick starting property of the fixing belt 101, a thickness of the film is set to be 100 μm or less than 100 μm. More preferably the thickness of the film is set to be in a range of 50 μm to 20 μm. The fixing belt 101 may be single layer of heat-resistant PTFE, PFA and FEP or may be a complex layer film in which PTFE, PFA, FEP or the like is coated on an outer circumferential surface of polyimide, polyamide, PEEK, PES, PPS or the like. The fixing belt 101 may be also a metallic film.

The fixing belt 101 constructed as described above rotates and comes into contact with the recording member S to fix the toner image on the recording member by heating the toner image borne on the recording member S. The fixing belt 101 rotates in a direction of an arrow J in FIG. 3 by being driven by the pressurizing roller 106.

Pressurizing Roller

As illustrated in FIG. 3, the pressurizing roller 106 serving as a counter member facing the fixing member is composed of a metallic core metal 106*a*, an elastic layer 106*b* molded and covered concentrically and integrally around the core metal 106*a* like a roller and a release layer provided on a surface layer of the elastic layer 106*b*. The elastic layer 106*b* is a heat-resistant and elastic layer such as silicon rubber, fluoro-rubber and fluoro-resin. The release layer may be made of a releasing and heat-resistant material selected from fluoro-resin, silicon resin, fluoro-silicon rubber, fluoro-rubber, silicon rubber, PFA, PTFE, FEP and the like.

As illustrated in FIG. 2, bearing members 113 formed of a heat-resistant resin such as PEEK, PPS and liquid crystal polymer are attached at both end parts of the core metal 106*a*. Then, the pressurizing roller 106 is rotatably supported by side plates of the fixing frame 112 through the bearing members 113. The pressurizing roller 106 is rotationally driven by a fixing motor provided within the apparatus body and not illustrated. The fixing belt 101 rotates in a direction of an arrow J in FIG. 3 by being driven by the pressurizing roller 106.

Heater

The heater 100 serving as a heating member is disposed within the fixing belt 101 and is a heat source for heating the fixing belt 101, and a ceramic heater is used in the present embodiment. The heater 100 is basically composed of a longitudinally long and thin plate-like ceramic substrate and a conductive heating resistor layer combined with the ceramic substrate and is a low heat capacity heater that rises temperature with sharp starting characteristics as a whole by electricity supplied from the apparatus body to a heating element.

Pressure Contact Member

The pressure contact member 103 is disposed inside of the fixing belt 101 and defines a nip portion N between the pressurizing roller 106 across the fixing belt 101. The pressure contact member 103 is a heat-resistant and heat insulating member having an approximately semi-circular shape in section orthogonal to the longitudinal direction. As for the pressure contact member 103, it is preferable to use an insulating and heat-resistant material such as phenol resin, polyimide resin, polyamide resin, polyamidimide resin, PEEK resin, PES resin, PPS resin, PFA resin, PTFE resin, LCP resin and the like.

The pressure contact member 103 defines the nip portion N between the fixing belt 101 and the pressurizing roller 106 by bringing the fixing belt 101 into pressure contact with the pressurizing roller 106 while backing up the fixing belt 101. Then, the pressure contact member 103 presses the nip portion N and stabilizes conveyance in rotating the fixing belt 101. Still further, the heater 100 described above is fitted in and supported by a fitting groove 103*a* defined at an under surface of the pressure contact member 103 along the longitudinal direction.

Stay

The stay 102 is disposed within the fixing belt 101 along the longitudinal direction in order to assure strength of the pressure contact member 103. That is, the stay 102 is made of a relatively flexible resin and is pressed against a back surface of the pressure contact member 103, i.e., on a surface opposite from the side on which the heater 100 is disposed, to keep longitudinal strength of the pressure contact member 103 and to correct the pressure contact member 103.

Fixing Flange

The fixing flanges 104 serving as holding portions are provided at longitudinal both ends of the fixing belt 101 to regulate a longitudinal moving amount of the fixing belt 101. That is, the fixing flanges 104 are fitted at both ends of an assembly of the pressure contact member 103 and the stay 102 to guide the rotation of the fixing belt 101 and to prevent the fixing belt 101 from falling out. In other words, the fixing flange 104 rotatably holds the fixing belt 101.

A pressurizing force in a direction of an arrow P in FIG. 2 is applied to the fixing flanges 104 disposed at the longitudinal both ends of the fixing belt 101 by a pressurizing plate not illustrated and rotatably mounted to the fixing frame 112. Thereby, the film unit 111 is pressurized toward the pressurizing roller 106.

Release Sheet

The release sheet 108 is disposed downstream of a recording member conveyance direction of the nip portion N so that a front end portion 108*a*-1 faces a surface of the fixing belt 101 through a gap δ to release the recording member S from the fixing belt 101. Such release sheet 108 is composed of two members of a release member 108*a* and a support member 108*b*. The release member 108*a* and the support member 108*b* are approximately plate-like members extending in the longitudinal direction, respectively. The release sheet 108 is constructed by fixing the release member 108*a* with the support member 108*b*. The release sheet 108 is disposed such that its longitudinal direction runs approximately in parallel with the longitudinal direction of the fixing belt 101 and such that the front end portion 108*a*-1 faces the surface of the fixing belt 101 through the gap δ.

Figure 4:
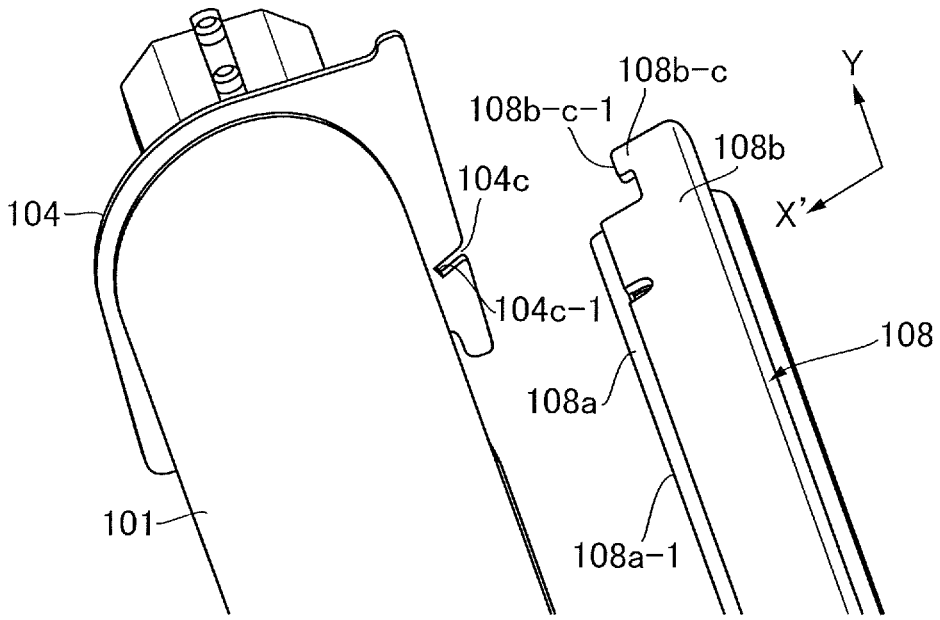
FIG. 4 is a perspective view illustrating a state of assembling a release sheet to a fixing flange.

As illustrated in FIG. 4, the support member 108*b* includes a positioning portion serving as a butting surface 108*b*-*c*-1. The positioning portion 108*b*-*c*-1 is provided on the support member 108*b* at a part in a first direction, i.e., in the Y direction, along the longitudinal direction of the fixing belt 101, i.e., at both ends in the present embodiment, and is positioned to the fixing flange 104 in terms of a second direction, i.e., in an X' direction, orthogonal to the Y direction. As illustrated in FIG. 3, the release member 108*a* is fixed to the support member 108*b* such that the front end portion 108*a*-1 faces the surface of the fixing belt 101 through the gap δ. Note that the front end portion 108*a*-1 is formed into an inverse crown shape concaved such that a center part, in terms of the X' direction, thereof is distant from the surface of the fixing belt 101 in a state of facing the surface of the fixing belt 101.

The release member 108*a* and the support member 108*b* are formed of metallic plate-like members such as iron, stainless, aluminum and copper, and the release sheet 108 is constructed by welding these two members by laser spot welding such as YAG laser. Detailed configurations how the release sheet 108 is fitted to the fixing flange 104 and how the release member 108*a* is fixed with the support member 108*b* will be described later.

Pressing Member

The pressing member 107 is a leaf spring member made of SUS for example for butting the positioning portion 108*b*-*c*-1 of the release sheet 108 against the fixing flange 104. As illustrated in FIG. 3, the pressing member 107 is attached to the fixing flange 104 by putting fitting holes not illustrated and provided at fitting portions 107*a* and 107*b* respectively onto projections 104*a* and 104*b* of the fixing flange 104.

The pressing member 107 is also disposed such that a pressing surface 107*c* thereof comes into contact with a pressed portion 108*b*-*d* provided at a longitudinal end portion, i.e., the end portion in the Y direction, of the release sheet 108 and on an opposite side from the front end portion 108*a*-1 in terms of the X' direction. Then, the pressing member 107 urges the release sheet 108 in a direction of approaching to the fixing belt 101 in terms of the X' direction by a spring force from the pressing member 107. Here, the pressing member 107 is attached by one each to the two fixing flanges 104 provided at the longitudinal both end portions of the fixing belt 101 to urge the longitudinal both end portions of the release sheet 108.

Attachment of Release Sheet

Next, a method for attaching the release sheet 108 to the fixing flange 104 will be described. FIG. 4 is a perspective view illustrating a Y direction end portion of the film unit 111 in a state before the release sheet 108 is attached to the film unit 111. In FIG. 4, the release sheet 108 is attached to the fixing flange 104 by inserting in the X' direction.

Attachment portions 108*b*-*c* are provided at both ends in the longitudinal direction, i.e., in the Y direction, of the support member 108*b*. Still further, a cut-away attached portion 104*c* to which the attachment portion 108*b-c* can enter is defined at a part of the fixing flange 104. Then, the support member 108*b* is positioned in a plate thickness direction, i.e., a direction perpendicular to the X' direction, and is fitted to the fixing flange 104 by engaging the attachment portion 108*b-c* with the attached portion 104*c*.

Still further, a front end surface in the X' direction of the attachment portion 108*b-c* is set as the positioning portion 108*b-c*-1 described above, and a surface of a rear side of the attached portion 104*c* is set as an attached portion 104*c*-1. Then, the positioning portion 108*b-c*-1 of the support member 108*b* butts against the attached portion 104*c*-1 of the fixing flange 104 by urging the release sheet 108 by the pressing member 107 described above. As a result, the release sheet 108 is attached to the fixing flange 104 in a state in which the short direction, i.e., the X' direction, of the release sheet 108 is positioned. The release sheet 108 is thus attached to the fixing flange 104 such that a shortest distance between the front end portion 108*a*-1 of the release sheet 108, i.e., a part where the recording member is released, and the fixing belt 101 becomes a predetermine gap δ, e.g., 1.0 mm.

Here, in the case of the fixing unit 40 using the fixing belt 101 like the present embodiment, it is required to appropriately set the gap δ described above to release the recording member from the fixing belt 101. That is, the fixing unit 40 of the present embodiment adopts a film heating method from aspects of quick start and energy saving. In the case of this method, the recording member bearing a non-fixed toner image is introduced between the fixing belt 101 and the pressurizing roller 106 defining the nip portion N. Then, the non-fixed toner image is fixed to the surface of the recording member by heat of the heater 100 applied through the fixing belt 101 and by the pressurizing force of the nip portion N by nipping and conveying the recording member together with the fixing belt 101.

Because the molten toner has adhesion, the toner tries to stick the recording member to the surface of the fixing belt 101 at this time. Due to that, there is a case where the recording member on which the toner image has been fixed at the nip portion N and is to be discharged coils around the fixing belt 101 after passing through the nip portion N as one technical problem of the fixing unit 40 described above. In order to solve such problem, according to the present embodiment, the release sheet 108 is closely disposed in an entire recording member conveyance region in the longitudinal direction of the fixing belt 101 and the front end portion thereof is introduced between the recording member and the fixing belt 101 to release the recording member from the fixing belt 101.

While the smaller the gap δ between the release sheet 108 and the fixing belt 101, the better the releasing performance is, there is a possibility that image defects occur as the fixing belt 101 is damaged if the release sheet 108 comes into contact with the fixing belt 101. Due to that, it is required to dispose the release sheet 108 at a position distant from the fixing belt 101 by the predetermined gap δ by taking component tolerance of the release sheet 108, including release performance and durability, into consideration.

In the configuration as described above, a distance L (see FIG. 8B) between the positioning portion 108*b-c*-1 and the front end portion 108*a*-1 of the release member 108*a* in an insert direction into the fixing flange 104 provided in the support member 108*b* is important to appropriately set the predetermined gap δ. This distance L is a distance in the direction in which the release sheet 108 is inserted into the fixing flange 104, i.e., the X' direction. The front end portion 108*a*-1 is a surface which is closest to the fixing belt 101 among the release sheet 108 and plays a role of releasing the recording member from the fixing belt 101.

As described above, the release sheet 108 includes the two members of the release member 108*a* and the support member 108*b* and is constructed by fixing the release member 108*a* with the support member 108*b*. Due to that, it is required to improve accuracy in attaching the release member 108*a* to the support member 108*b* in order to appropriately set the abovementioned distance L.

COMPARATIVE EXAMPLE

Here, a method for fixing the release member 108*a* with a support member 108*b*' in a comparative example will be described with reference to FIGS. 5A and 5B. In the comparative example, a jig 300 is used to fix the release member 108*a* to the support member 108*b*'. The jig 300 includes one each, two in total, columnar pins or shafts 300*a* and 300*b* projectively provided at longitudinal both end sides on an approximately rectangular base table 301. The jig 300 also includes a pressing member not illustrated for pressing the release sheet 108 and the support member 108*b*' in a Z1 direction, i.e., a direction perpendicular to X1 and Y1 directions or in a front and rear direction of drawings of FIGS. 5A and 5B.

Meanwhile, the support member 108*b*' is provided with a round hole 108*b-a*' and an oblong hole 108*b-b*' defined respectively on longitudinal both end sides in the Y1 direction. The release member 108*a* is also provided with a round hole 108*a-a* and an oblong hole 108*a-b* respectively defined on the longitudinal both end sides in the Y1 direction.

Figure 5A:
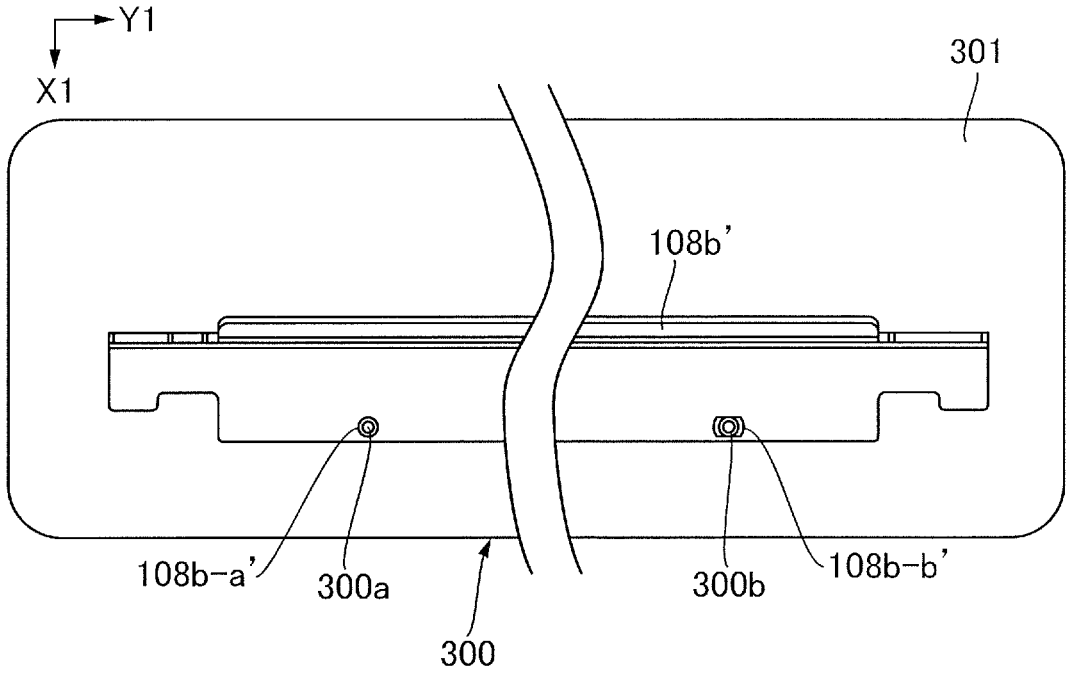
FIG. 5A is a plan view illustrating a state in which a support member of a comparative example is fixed to a jig.

Firstly, FIG. 5A illustrates a state in which the support member 108*b*' is attached to the jig 300 on which the support member 108*b*' is seen from a front direction. In FIG. 5A, the support member 108*b*' is positioned in terms of the X1 direction, i.e., a short direction orthogonal to the Y1 direction, and the Y1 direction by inserting a pin 300*a* into the round hole 108*b-a*'. Still further, the support member 108*b*' is positioned in a rotation direction of a X1-Y1 plane around the round hole 108*b-a*' by inserting a pin 300*b* into the oblong hole 108*b-b*'.

Next, the release member 108*a* is mounted so as to cover the support member 108*b*'. FIG. 5B illustrates a state in which the release member 108*a* is attached to the jig 300 in which the release member 108*a* is seen from the front direction. As illustrated in FIG. 5B, the release member 108*a* is positioned in terms of the X1 and Y1 directions by inserting the pin 300*a* through the round hole 108*a-a*. The release member 108*a* is also positioned in the rotation direction of the X1-Y1 plane by inserting the oblong hole 108*a-b* into the pin 300*b*.

From this state, the release member 108*a* and the support member 108*b*' are pressed in the Z1 direction (see FIG. 7 described later) by a pressing member not illustrated and provided in the jig 300. Then, a laser is emitted across the longitudinal direction from the release member 108*a* side to the support member 108*b*' side, i.e., in the Z1 direction. For instance, the laser is emitted at intervals of 20 mm in the longitudinal direction at a position of a broken line S in FIG. 5B where the release member 108*a* is in contact with the support member 108*b*'. Thereby, the release member 108*a* and the support member 108*b*' are fixed by welding.

Component Tolerance of Release Sheet

Next, component tolerances of the release member 108*a* and the support member 108*b*' in terms of a distance L' in the X1 direction between the front end portion 108*a*-1 of the release member 108*a* and the positioning portion 108*b*-*c*-1' of the fixing flange 104 in the comparative example will be described. At first, the positions of the holes provided by two each respectively through the release member 108*a* and the support member 108*b*' have component tolerances in terms of hole positions from nominal positions of the holes of the respective members. Because the release member 108*a* and the support member 108*b*' are fixed by positioning the holes that may deviate from the nominal position by the jig, component tolerance of the distance L' increases in the comparative example.

Figure 5B:
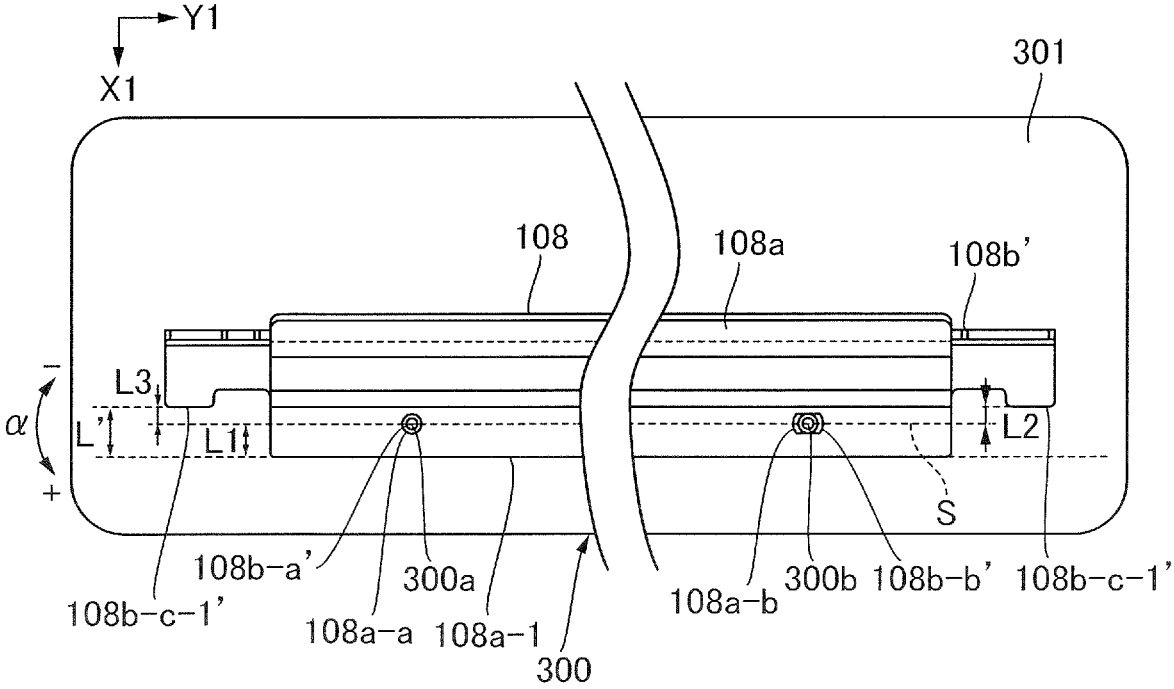
FIG. 5B is a plan view illustrating a state in which the support member and a release member of the comparative example are fixed to jig.

Specifically, the following accuracies indicated in FIG. 5B affect the component tolerance of the distance L':

(1) Accuracy of hole diameter or of hole width of the round hole 108*a*-*a* and the oblong hole 108*a*-*b* of the release member 108*a;*

(2) Accuracy of a distance L1 from hole center of the round hole 108*a*-*a* and the oblong hole 108*a*-*b* to the front end portion 108*a*-1 of the release member 108*a;*

(3) Accuracy of hole diameter or of hole width of the round hole 108*b*-*a*' and the oblong hole 108*b*-*b*' of the support member 108*b*'; and (4) Accuracy of distances L2 and L3 between the positioning portion 108*b*-*c*-1' to the hole center of the round hole 108*b*-*a*' and the oblong hole 108*b*-*b*' and to the fixing flange 104.

Because the plurality of accuracies thus affect the component tolerance of the distance L', there is a case where a difference of both ends of the distance L' in the X1 direction between the positioning portion 108*b*-*c*-1' to the front end portion 108*a*-1 of the release member 108*a* and to the fixing flange 104 increases. That is, a relative position of the release member 108*a* to the support member 108*b*' deviates in + or − direction in a diction of an arrow a in FIG. 5B. Thus, there is a case where the component tolerance of the distance L' increases. For instance, the component tolerance of the distance L' is ±0.1 mm in the configuration of the comparative example.

If the component tolerance of the distance L' thus increases, there is a case where the distance δ between the front end position 108*a*-1 of the release sheet 108 and the fixing belt 101 becomes shorter than a permissible distance in terms of design. In this case, the fixing belt 101 may interfere with the release sheet 108, thus causing image defects as described above. Accordingly, the gap δ between the front end portion 108*a*-1 of the release sheet 108 and the fixing belt 101 is set at a position not interfering with the fixing belt 101 by taking component variations of the release sheet 108 into account.

However, demands on thin sheets having small grammage and on recycled sheets, considering the environment, are increasing lately more than the past, and in a case where such recording member is used, there is a case where it is difficult to release the recording member from the fixing belt 101 if the gap δ is large. Accordingly, the present embodiment enables to dispose the release sheet 108 at a position closer to the fixing belt 101 and to improve the release performance more than the past by reducing the component tolerance of the release sheet 108.

Figure 6A:
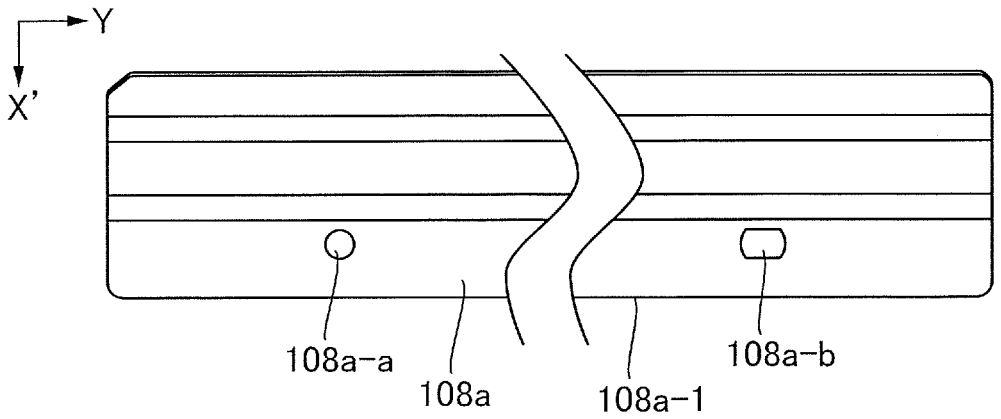
FIG. 6A is a plan view of a release member of the first embodiment.
Figure 6B:
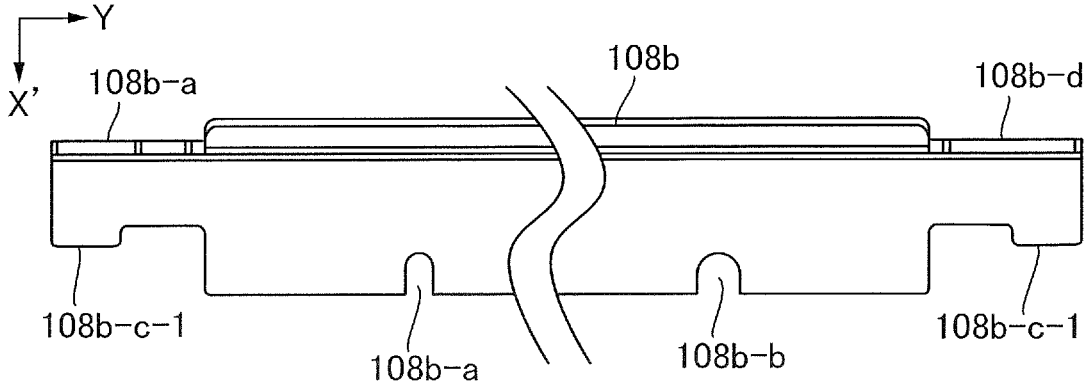
FIG. 6B is a plan view of a support member of the first embodiment.

Positioning Configuration of Release Member and Supporting Member in First Embodiment Firstly, detailed shapes related to positioning of the release member 108*a* and the support member 108*b* in the present embodiment will be described with reference to FIGS. 6A and 6B. FIG. 6A illustrates the release member 108*a* seen from the front side, and FIG. 6B illustrates the support member 108*b* seen from the front side.

As illustrated in FIG. 6A, the release member 108*a* is provided with a round hole 108*a*-*a* and an oblong hole 108*a*-*b* defined respectively by one each at both end sides in the longitudinal direction, i.e., in the Y direction and a first direction. Meanwhile, as illustrated in FIG. 6B, the support member 108*b* is provided with notches 108*b*-*a* and 108*b*-*b* respectively defined by one each at both end sides in the longitudinal direction, i.e., in the Y direction. The round hole 108*a*-*a*, the oblong hole 108*a*-*b* and the notches 108*b*-*a* and 108*b*-*b* are openings for adjusting the distance of the front end portion 108*a*-1 of the release member 108*a* to the positioning portion 108*b*-*c*-1 of the support member 108*b* in terms of the X' direction, i.e., in a second direction. Note that the X' direction is a short direction of the release sheet 108 and is a direction in which the release sheet 108 is attached to the fixing flange 104, and the Y direction is the longitudinal direction of the release sheet 108. The respective holes and the respective notches will be specifically described below.

The notch 108*b*-*a* serving as a first opening is an opening in which X' direction, i.e., the second direction, thereof is longer than the Y direction, i.e., the first direction. The notch 108*b*-*b* serving as a third opening is an opening in which the Y direction thereof is longer than the notch 108*b*-*a*. That is, a width in the Y direction of the notch 108*b*-*b* is wider than that of the notch 108*b*-*a*. Still further, the notches 108*b*-*a* and 108*b*-*b* are cut away so as to open to the end portion in the X' direction, i.e., to the end portion in the second direction, of the support member 108*b*. Note that a width in the X' direction, i.e., a depth of the notches, of the notches 108*b*-*a* and 108*b*-*b* are set to be equal.

The round hole 108*a*-*a* serving as a second opening is defined at a position where at least a part thereof overlaps with the notch 108*b*-*a* in a state in which the release member 108*a* is fixed with the support member 108*b* and is an opening having a length in the X' direction shorter than the length of the notch 108*b*-*a*. The oblong hole 108*a*-*b* serving as a fourth opening is defined at a position where at least a part thereof overlaps with the notch 108*b*-*b* in a state in which the release member 108*a* is fixed with the support member 108*b* and is an opening having a length in the Y direction longer than that of the round hole 108*a*-*a*. It is noted that a width in the X' direction of the oblong hole 108*a*-*b* is approximately equal with an inner diameter of the round hole 108*a*-*a*.

The round hole 108*a*-*a* of the release member 108*a* is what determines positions in the X' direction and the Y direction by a jig 200 described later. The oblong hole 108*a*-*b* is what stops the release member 108*a* from rotating centering on the round hole 108*a*-*a*. The notch 108*b*-*a* is what determines a position in the Y direction of the support member 108*b*. The notch 108*b*-*b* is what avoids interference with a pin 200*b* of the jig 200 (see FIGS. 7 and 8B).

About Jig

Figure 7:
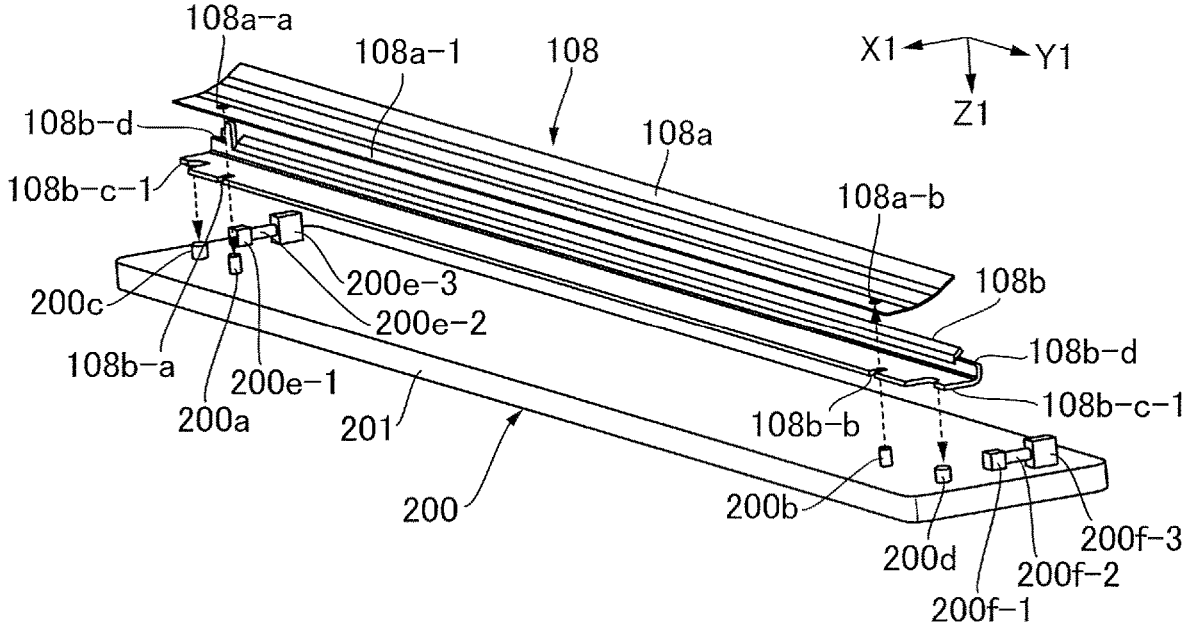
FIG. 7 is a perspective view illustrating a state in which the support member and the release member of the first embodiment are attached to a jig.
Figure 8A:
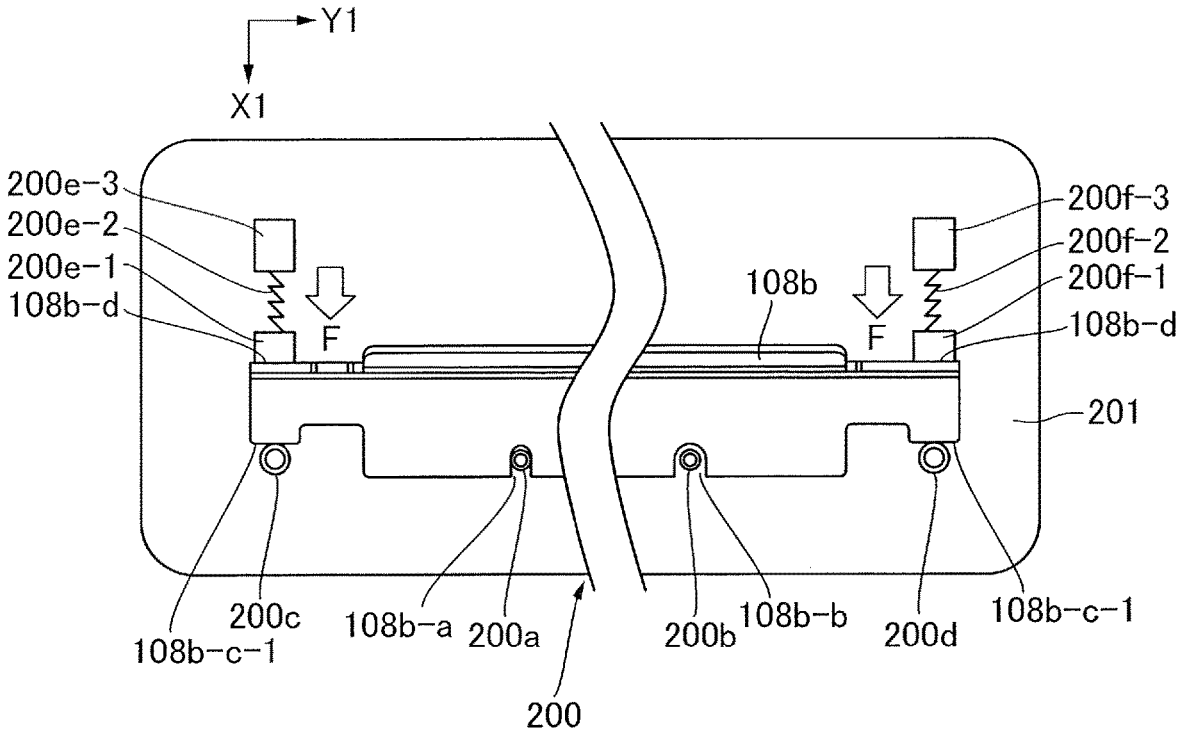
FIG. 8A is a plan view illustrating a state in which the support member of the first embodiment is fixed to the jig.
Figure 8B:
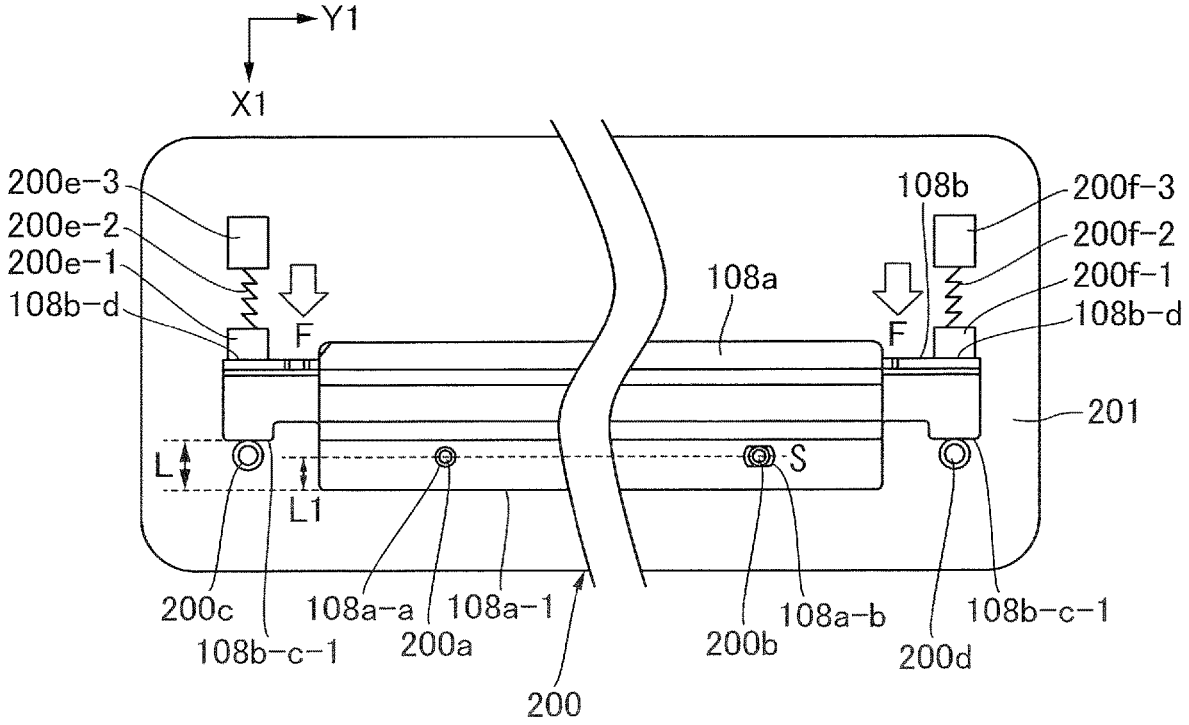
FIG. 8B is a plan view illustrating a state in which the support member and the release member of the first embodiment are fixed to the jig.

Next, the jig 200 used in fixing the release member 108*a* with the support member 108*b* will be described with reference to FIGS. 7, 8A and 8B. In FIGS. 7, 8A and 8B, the short direction of the support member 108*b* is the X1 direction, the longitudinal direction of the release sheet 108 is a Y1 direction and a direction in which the release sheet 108 is inserted into the jig 200, i.e., a thickness direction of the release sheet 108 or a front and rear direction of the drawings FIGS. 8A and 8B, is the Z1 direction.

The jig 200 includes pins 200*a* and 200*b* serving as shafts, abutment pins 200*c* and 200*d* serving as abutment portions, pressing portions 200*e*-1 and 200*f*-1, compression springs

200*e*-2 and 200*f*-2 serving as urging portions and fixing portions 200*e*-3 and 200*f*-3, respectively on a base table 201.

Firstly, the pins 200*a* and 200*b* are columnar shafts to be inserted into the notches 108*b*-*a* and 108*b*-*b*, the round hole 108*a*-*a* and the oblong hole 108*a*-*b* and are provided at longitudinal both end sides of the base table 201 so as to project in the Z1 direction. The pins 200*a* and 200*b* are disposed such that centers of the shafts are positioned on a same line in the Y1 direction.

The abutment pins 200*c* and 200*d* are columnar shafts against which the positioning portions 108*b*-*c*-1 at the longitudinal both ends of the support member 108*b* butt and are provided at the longitudinal both end sides of the base table 201 so as to project in the Z1 direction in the present embodiment. The abutment pins 200*c* and 200*d* are disposed such that abutment parts, i.e., the positioning portions 108*b*-*c*-1, at the longitudinal both ends of the support member 108*b* are positioned on a same line in the Y1 direction.

The pressing portions 200*e*-1 and 200*f*-1 press the support member 108*b* against the abutment pins 200*c* and 200*d*. Due to that, the pressing portions 200*e*-1 and 200*f*-1 are provided movably on the base table 201. Still further, the pressing portions 200*e*-1 and 200*f*-1 are disposed at positions where the pressing portions 200*e*-1 and 200*f*-1 can abut with the pressed portions 108*b*-*d* provided at the longitudinal both end portions of the support member 108*b*.

Both ends of the compression springs 200*e*-2 and 200*f*-2 are fitted respectively at the pressing portions 200*e*-1 and 200*f*-1 and the fixing portions 200*e*-3 and 200*f*-3 to apply a pressing force to the pressing portions 200*e*-1 and 200*f*-1. That is, the compression springs 200*e*-2 and 200*f*-2 are provided such that one side end portions thereof are fixed to the fixing portions 200*e*-3 and 200*f*-3 and other side end portions thereof are fixed to the pressing portions 200*e*-1 and 200*f*-1 to urge the pressing portions 200*e*-1 and 200*f*-1 in the X1 direction.

The fixing portions 200*e*-3 and 200*f*-3 fix the one side end portions of the compression springs 200*e*-2 and 200*f*-2 to the jig 200. Therefore, the fixing portions 200*e*-3 and 200*f*-3 are fixed on sides opposite from the positioning portions 108*b*-*c*-1 rather than the pressing portions 200*e*-1 and 200*f*-1 in terms of the X1 direction on the base table 201.

Manufacturing Method of Release Sheet

Next, a manufacturing method of the release sheet 108 obtained by integrating the release member 108*a* with the support member 108*b* by welding will be described. FIG. 7 illustrates a state in which the release member 108*a* and the support member 108*b* are assembled to the jig 200. FIG. 8A illustrates a state in which the support member 108*b* is fixed to the jig 200 when the support member 108*b* is seen from the front direction. FIG. 8B illustrates a state in which the release member 108*a* is fixed to the jig 200 when the release member 108*a* is seen from the front direction.

First Step

Firstly, the support member 108*b* is mounted to the jig 200. That is, the support member 108*b* is installed on the jig 200 such that the pins 200*a* and 200*b* insert through the notches 108*b*-*a* and 108*b*-*b* in a first step. More specifically, as illustrated in FIG. 8A, the position in the Y1 direction of the support member 108*b* is determined by inserting the pin 200*a* through the notch 108*b*-*a* which is a positioning hole in the Y1 direction. Still further, the pin 200*b* is inserted through the notch 108*b*-*b* of the support member 108*b* in a state in which the pin 200*b* is not in contact with the notch 108*b*-*b*.

Then, the support member 108*b* is pressed as the pressed portions 108*b*-*d* at both ends in the Y1 direction are pressed in a direction of an arrow F by the pressing portions 200*e*-1 and 200*f*-1 by spring forces from the compression springs 200*e*-2 and 200*f*-2. Then, the support member 108*b* is positioned in the X1 direction as the positioning portions 108*b*-*c*-1 which are abutment surfaces to the fixing flange 104 provided at both ends of the support member 108*b* abut respectively with the abutment pins 200*c* and 200*d*.

Second Step

Next, the release member 108*a* is mounted so as to cover the support member 108*b*. That is, the release member 108*a* is installed on the jig 200 on which the support member 108*b* has been installed such that the pins 200*a* and 200*b* are inserted through the round hole 108*a*-*a* and the oblong hole 108*a*-*b* in a second step. More specifically, as illustrated in FIG. 8B, the release member 108*a* is positioned in the X1 and Y1 directions by inserting the pin 200*a* through the round hole 108*a*-*a* which is the positioning hole in the X1 and Y1 directions. Still further, the release member 108*a* is positioned in a rotation direction of a X1-Y1 plane by inserting the pin 200*b* into the oblong hole 108*a*-*b* for stopping the X1-Y1 plane from rotating around the round hole 108*a*-*a* of the release member 108*a*.

At this time, the support member 108*b* is in a state of being positioned in the X1 and Y1 directions while being applied with the force in the direction of the arrow F as described above. Then, the release member 108*a* and the support member 108*b* are pressed in the Z1 direction by a pressing member not illustrated and provided on the jig 200 from this state.

Third Step

Finally, the release member 108*a* is fixed with the support member 108*b*. That is, the release member 108*a* is fixed with the support member 108*b* in a state in which the positioning portions 108*b*-*c*-1 are brought into contact with the abutment pins 200*c* and 200*d* by urging the support member 108*b* by the compression springs 200*e*-2 and 200*f*-2 in third step. More specifically, laser is emitted across the longitudinal direction from the release member 108*a* side to the support member 108*b* side, i.e., in the Z1 direction. For instance, the laser is emitted at intervals of 20 mm at a position of a broken line S in FIG. 8B where the release member 108*a* is in contact with the support member 108*b*. Thus, the release member 108*a* is fixed with the support member 108*b* by welding.

The release member 108*a* is fixed with the support member 108*b* by welding, and the release sheet 108 can be obtained by the steps as described above. Note that there is also a case where other predetermined processes such as coating are implemented.

Component Tolerance of Release Sheet in First Embodiment

Next, component tolerances of the release member 108*a* and the support member 108*b* in terms of the distance L in the X1 direction of the positioning portions 108*b*-*c*-1 to the front end portion 108*a*-1 of the release member 108*a* and the fixing flange 104 of the present embodiment will be described.

Component tolerance of the distance L by the component tolerances of the release member 108*a* and the support member 108*b* of the present embodiment is affected by the following accuracies:

(1) Accuracy of a hole diameter or a hole width of the round hole 108*a*-*a* and the oblong hole 108*a*-*b* of the release member 108*a*; and (2) Accuracy of a distance L1 from hole center of the round hole 108*a*-*a* and the oblong hole 108*a*-*b* to the front end portions 108*a*-1 of the release member 108*a*.

That is, while the component tolerance of the distance L' has been affected by the accuracies (1) through (4) described above in the comparative example, only two accuracies (1) and (2) affect the component tolerance of the distance L in the present embodiment. Therefore, the component tolerance of the distance L of the present embodiment can be reduced as compared to the case of the comparative example.

More specifically, the openings through which the pins 200*a* and 200*b* are inserted are the notches 108*b-a* and 108*b-b* having a length in the X1 direction longer than a length in the Y1 direction in the case of the present embodiment. Due to that, even when the pins 200*a* and 200*b* are inserted through the notches 108*b-a* and 108*b-b*, the pins 200*a* and 200*b* are slightly movable in the X1 direction. That is, while the support member 108*b* is positioned in the Y1 direction, it is not positioned in the X1 direction. Then, in this state, the support member 108*b* is urged by the compression springs 200*e*-2 and 200*f*-2 to cause the positioning portions 108*b-c*-1 to abut with the abutment pins 200*c* and 200*d*. Therefore, the position of the positioning portions 108*b-c*-1 in the X1 direction with respect to the jig 200 is dependent on the accuracy of positions of the abutment pins 200*c* and 200*d*, regardless of the positional accuracy of the notches 108*b-a* and 108*b-b*.

Next, if the release member 108*a* is mounted to the support member 108*b* positioned as described above, the position in the X1 direction of the release member 108*a* is determined by inserting the pins 200*a* and 200*b* into the round hole 108*a-a* and the oblong hole 108*a-b*. Due to that, the position of the release member 108*a* in the X1 direction with respect to the jig 200 is dependent on the accuracy of the round hole 108*a-a* and the oblong hole 108*a-b* and on the accuracy of positions of the pins 200*a* and 200*b*.

Here, if the accuracy of the positional relationship between the pins 200*a* and 200*b* of the jig 200 and the abutment pins 200*c* and 200*d* is high, the distance L between the positioning portions 108*b-c*-1 and the front end portion 108*a*-1 is mainly dependent on the component tolerance between the support member 108*b* and the release member 108*a*. Because the position of the positioning portion 108*b-c*-1 in the X1 direction with respect to the jig 200 is not dependent on the accuracy of the notches 108*b-a* and 108*b-b* as described above, the distance L is affected by the component tolerance of the release member 108*a*. That is, the distance L is affected by the accuracies (1) and (2) described above and is not affected by the accuracies (3) and (4) described in the comparative example.

Due to that, the present embodiment enables to obtain the release sheet 108 in which the tolerance of the distance L caused by the component tolerances of the release member 108*a* and the support member 108*b* is small. For instance, while the component tolerance of the distance L' was ±0.1 mm in the comparative example, it becomes possible to reduce the component tolerance of the distance L to ±0.05 mm in the present embodiment. If the component tolerance of the distance L can be reduced as described above or it is possible to obtain the release sheet 108 having such small component tolerance, the gap δ between the front end portion 108*a*-1 and the fixing belt 101 can be reduced and the release performance can be improved.

Note that the first and third openings defined through the support member 108*b* have been the notches 108*b-a* and 108*b-b* in the abovementioned description, the first and third openings may be oblong holes which are oblong in the X1 direction.

Still further, while one member through which the first and third openings are defined has been the support member 108*b* and the other member through which the second and fourth openings are defined has been the release member 108*a* in the abovementioned description, these relationships may be reversed. That is, the release member may be the one member and the first and third openings may be defined through the release member. The support member may be also the other member and the second and fourth openings may be defined through the support member. Note that in a case where the notches are defined through the release member as the first and third openings, it is preferable to define them at regions deviated from regions coming into contact with the recording member in terms the longitudinal direction of the front end portion.

As for a manufacturing method of this case, the support member is installed in a state in which the support member is positioned in the X1 and Y1 directions in the same manner with the release member 108*a* as illustrated in FIG. 8B. Still further, the release member is installed in a state in which the support member is positioned in the X1 and Y1 direction in the same manner with the support member 108*b* as illustrated in FIG. 8A. Then, the release member is fixed with the support member in a state in which the release member is urged in the X1 direction so that the front end portion of the release member abuts with the abutment pin provided on the jig. This arrangement makes it possible to reduce the component tolerance of the distance L in the same manner as described above.

Second Embodiment

A second embodiment will be described with reference to FIGS. 9A and 9B. The present embodiment is different from the first embodiment in that there is no hole shape for determining relative positions in a rotation direction of the release member 108*a* and the support member 108*b* in terms of the shapes of the release member 108*a* and the support member 108*b* described in the first embodiment. Because the other configurations and operations are the same with those of the first embodiment, the same configurations will not be illustrated and their description will be omitted here.

Note that the reference signs of the release sheet are changed as a release sheet 208, a release member 208*a*, a support member 208*b*, a front end portion 208*a*-1 and a positioning portion 208*b-c*-1. The front end portion 208*a*-1 of the release member 208*a* includes an inverse crown portion 208*d* and a straight portion 208*e*. The inverse crown portion 208*d* is a part where a center part of the front end portion 208*a*-1, in terms of the X1 direction, is concaved in a direction of separating from the surface of the fixing belt 101 more than the both end portions and has an inverse crown shape in a state in which the front end portion 208*a*-1 faces the surface of the fixing belt 101 (see FIG. 3). The straight portion 208*e* is a part formed approximately in parallel with the Y1 direction on the both end sides in the Y1 direction, i.e., on the both end sides in the first direction, of the inverse crown portion 208*d*.

At first, detailed shapes concerning positioning of the release member 208*a* and the support member 208*b* in the present embodiment will be described with reference to FIGS. 9A and 9B. FIG. 9A illustrates the support member 208*b* seen from the front side and FIG. 9B illustrates the release member 208*a* seen from the front side.

Figure 9A:
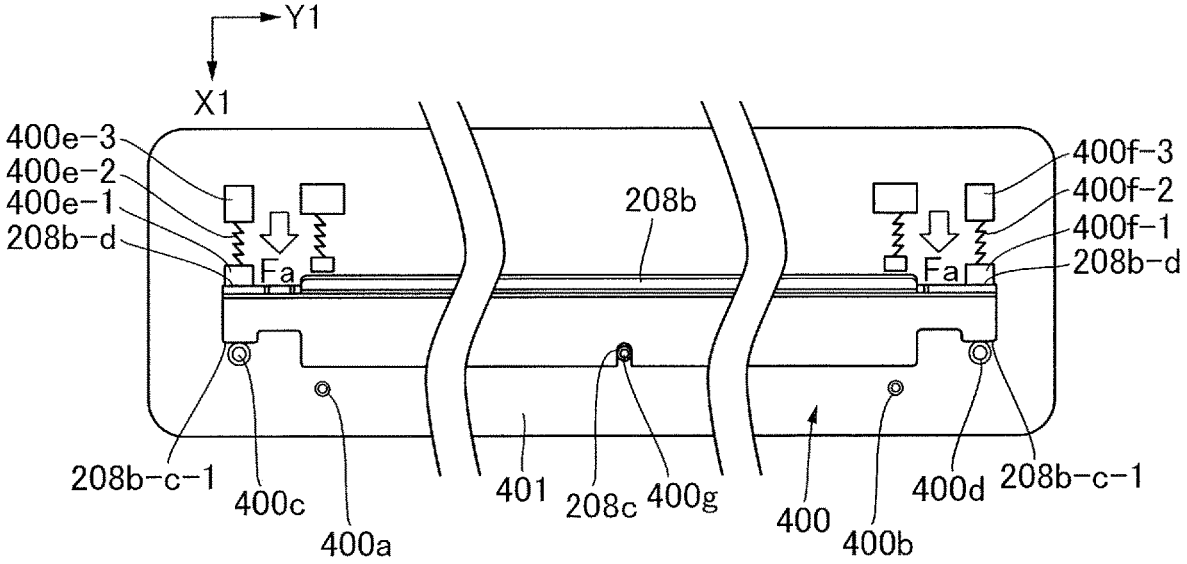
FIG. 9A is a plan view illustrating a state in which a support member of a second embodiment is fixed to a jig.
Figure 9B:
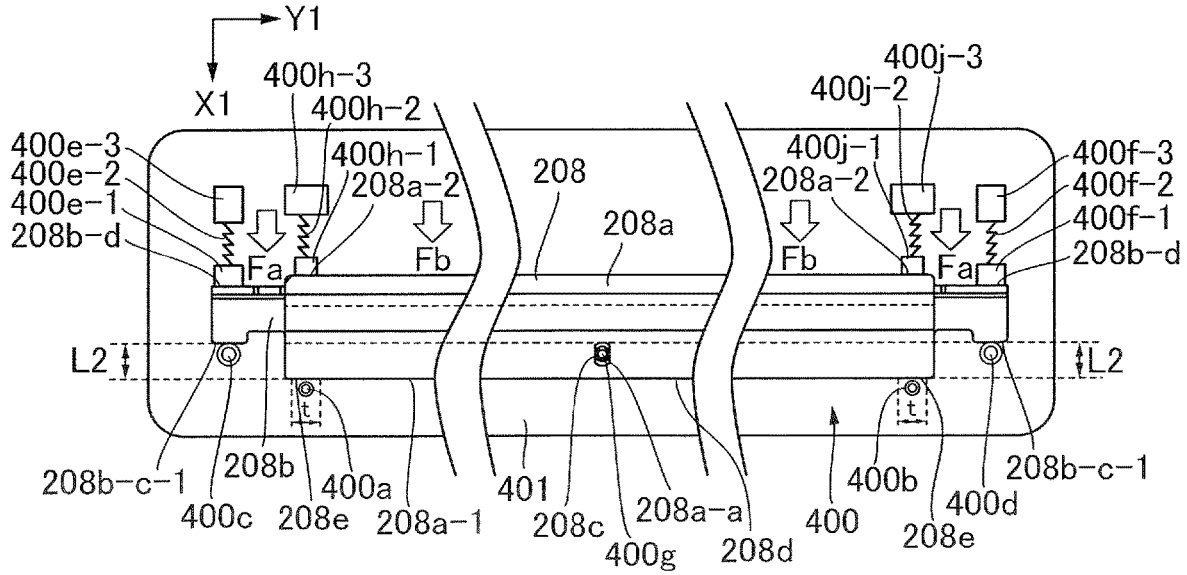
FIG. 9B is a plan view illustrating a state in which the support member and a release member of the second embodiment are fixed to the jig.

As illustrated in FIG. 9B, the release member 208*a* is provided with one oblong hole 208*a-a* defined at approximately center in the longitudinal direction, i.e., the Y direction or the first direction, of the release member 208*a*. Meanwhile, as illustrated in FIG. 9A, the support member 208*b* is provided with one notch 208*c* at approximately center in the longitudinal direction, i.e., in the Y direction of the support member 208*b*. The oblong hole 208*a-a* and the notch 208*c* are openings for adjusting a distance of the front end portion 208*a*-1 of the release member 208*a* to the positioning portion 208*b-c*-1 of the support member 208*b* in terms of the X1 direction, i.e., in a second direction. Note that the X1 direction is a short direction of the release sheet 208 and is a direction in which the release sheet 208 is attached to the fixing flange 104 (see FIGS. 3 and 4), and the Y1 direction is a longitudinal direction of the release sheet 208. The respective holes and notches will be specifically described below.

The notch 208*c* serving as a fifth opening is an opening having a length in the X1 direction, i.e., in the second direction, longer than a length in the Y1 direction, i.e., in the first direction. The notch 208*c* is also cut away so as to open to an X1 direction end portion, i.e., to a second direction end portion, of the support member 208*b*. The oblong hole 208*a-a* serving as a sixth opening is defined at a position where at least a part thereof overlaps with the notch 208*c* in a state in which the release member 208*a* is fixed with the support member 208*b* and is an opening having a length in the X1 direction, i.e., in the second direction, longer than a length in the Y1 direction, i.e., in the first direction. The oblong hole 208*a-a* does not reach the X1 direction end portion, i.e., the second direction end portion, of the release member 208*a*. The oblong hole 208*a-a* of the release member 208*a* and the notch 208*c* of the support member 208*b* determine positions in the Y1 direction respectively by a jig 400 described later.

About Jig

Next, the jig 400 used in fixing the release member 208*a* with the support member 208*b* will be described. The jig 400 includes a pin 400*g* serving as a shaft, first abutment pins 400*a* and 400*b* serving as a first abutment portion, second abutment pins 400*c* and 400*d* serving as a second abutment portion. The jig 400 also includes first compression springs 400*h*-2 and 400*j*-2 serving as a first urging portion and second compression springs 400*e*-2 and 400*f*-2 serving as a second urging portion. The jig 400 further includes first pressing portions 400*h*-1 and 400*j*-1, second pressing portions 400*e*-1 and 400*f*-1, first fixing portions 400*h*-3 and 400*j*-3 and second fixing portions 400*e*-3 and 400*f*-3. These are provided respectively on a base table 401.

Firstly, the pin 400*g* is a columnar shaft inserted through the notch 208*c* and the oblong hole 208*a-a* and is provided approximately at center in the longitudinal direction of the base table 401 so as to project in the Z1 direction, i.e., in a direction orthogonal to the X1 and Y1 directions or a front and back direction of the drawings of FIGS. 9A and 9B.

The first abutment pins 400*a* and 400*b* are columnar shafts against which a part of the front end portion 208*a*-1 of the release member 208*a* or a straight portion 208*e* at the longitudinal both ends of the release member 208*a* in the present embodiment butt and are provided at the longitudinal both end sides of the base table 401 so as to project in the Z1 direction. The first abutment pins 400*a* and 400*b* are also disposed such that abutment parts, i.e., the straight part 208*e*, at the longitudinal both ends of the front end portion 208*a*-1 are positioned on a same line in the Y1 direction.

The second abutment pins 400*c* and 400*d* are columnar shafts against which the positioning portions 208*b-c*-1 at the longitudinal both ends of the support member 208*b* butt and are provided at the longitudinal both end sides of the base table 401 so as to project in the Z1 direction. The second abutment pins 400*c* and 400*d* are disposed such that abutment parts, i.e., the positioning portions 208*b-c*-1, at the longitudinal both ends of the support member 208*b* are positioned on a same line in the Y1 direction.

The first pressing portions 400*h*-1 and 400*j*-1 press the release member 208*a* against the first abutment pins 400*a* and 400*b*. Due to that, the first pressing portions 400*h*-1 and 400*j*-1 are provided movably on the base table 401. Still further, the first pressing portions 400*h*-1 and 400*j*-1 are disposed at positions where the first pressing portions 400*h*-1 and 400*j*-1 can abut with the pressed portions 208*a*-2 provided at the longitudinal both end portions of the release member 208*a* and at an opposite side of the front end portion 208*a*-1.

The second pressing portions 400*e*-1 and 400*f*-1 press the support member 208*b* against the second abutment pins 400*c* and 400*d*. Due to that, the second pressing portions 400*e*-1 and 400*f*-1 are provided movably on the base table 401. Still further, the second pressing portions 400*e*-1 and 400*f*-1 are disposed at positions where the second pressing portions 400*e*-1 and 400*f*-1 can abut with the pressed portions 208*b-d* provided at the longitudinal both end portions of the support member 208*b*.

Both ends of the first compression springs 400*h*-2 and 400*j*-2 are fitted respectively at the first pressing portions 400*h*-1 and 400*j*-1 and the first fixing portions 400*h*-3 and 400*j*-3 to apply a pressing force to the first pressing portions 400*h*-1 and 400*j*-1. That is, the first compression springs 400*h*-2 and 400*j*-2 are provided such that one side end portions thereof are fixed to the first fixing portions 400*h*-3 and 400*j*-3 and other side end portions thereof are fixed to the first pressing portions 400*h*-1 and 400*j*-1 to urge the first pressing portions 400*h*-1 and 400*j*-1 in the X1 direction.

Both ends of the second compression springs 400*e*-2 and 400*f*-2 are fitted respectively at the second pressing portions 400*e*-1 and 400*f*-1 and the second fixing portions 400*e*-3 and 400*f*-3 to apply a pressing force to the second pressing portions 400*e*-1 and 400*f*-1. That is, the second compression springs 400*e*-2 and 400*f*-2 are provided such that the one side end portions thereof are fixed to the second fixing portions 400*e*-3 and 400*f*-3 and the other side end portions thereof are fixed to the second pressing portions 400*e*-1 and 400*f*-1 to urge the second pressing portions 400*e*-1 and 400*f*-1 in the X1 direction.

The first fixing portions 400*h*-3 and 400*j*-3 fix one side end portions of the first compression springs 400*h*-2 and 400*j*-2 to the jig 400. Therefore, the first fixing portions 400*h*-3 and 400*j*-3 are fixed on a side opposite from the straight portion 208*e* more than the first pressing portions 400*h*-1 and 400*j*-1 in terms of the X1 direction on the base table 401.

The second fixing portions 400*e*-3 and 400*f*-3 fix the one side end portions of the second compression springs 400*e*-2 and 400*f*-2 to the jig 400. Therefore, the second fixing portions 400*e*-3 and 400*f*-3 are fixed on a side opposite from the positioning portions 208*b-c*-1 rather than the second pressing portions 400*e*-1 and 400*f*-1 in terms of the X1 direction on the base table 401.

Manufacturing Method of Release Sheet

Next, a manufacturing method of the release sheet 208 obtained by integrating the release member 208*a* with the support member 208*b* by welding will be described. FIG. 9A illustrates a state in which the support member 208*b* is fixed to the jig 400 when the support member 208*b* is seen from the front direction. FIG. 9B illustrates a state in which the release member 208*a* is fixed to the jig 400 when the release member 208*a* is seen from the front direction.

First Step

Firstly, the support member 208*b* is mounted to the jig 400. That is, the support member 208*b* is installed on the jig 400 such that the pin 400*g* is inserted through the notch 208*c* in a first step. More specifically, as illustrated in FIG. 9A, the position in the Y1 direction of the support member 208*b* is determined by inserting the pin 400*g* through the notch 208*c* which is a positioning hole in the Y1 direction.

Then, the support member 208*b* is pressed as the pressed portions 208*b-d* at both ends in the Y1 direction are pressed in a direction of an arrow Fa by the second pressing portions 400*e*-1 and 400*f*-1 by spring forces from the second compression springs 400*e*-2 and 400*f*-2. Then, the support member 208*b* is positioned in the X1 direction as the positioning portions 208*b-c*-1 which are abutment surfaces to the fixing flange 104 provided at both ends of the support member 208*b* abut respectively with the second abutment pins 400*c* and 400*d*.

Second Step

Next, the release member 208*a* is mounted so as to cover the support member 208*b*. That is, the release member 208*a* is installed on the jig 400 on which the support member 208*b* has been installed such that the pin 400*g* inserts through the oblong hole 208*a-a* in a second step. More specifically, as illustrated in FIG. 9B, the release member 208*a* is positioned in the Y1 direction by inserting the pin 400*g* through the oblong hole 208*a-a* which is the positioning hole in the Y1 direction.

Then, the pressed portions 208*a*-2 on the release member 208*a* in the both ends in the Y1 direction are pressed in a direction an arrow Fb by the first pressing members 400*h*-1 and 400*j*-1 by spring forces from the first compression springs 400*h*-2 and 400*j*-2. Then, the release member 208*a* is positioned in the X1 direction as the straight portion 208*e* which is a region parallel to the Y1 direction of the front end portion 208*a*-1 of the release member 208*a*, i.e., parts of ranges t at both end portions in the Y1 direction in FIG. 9B, abut respectively with the first abutment pins 400*a* and 400*b*. From this state, the release member 208*a* and the support member 208*b* are pressed in the Z1 direction by a pressing member not illustrated and provided on the jig 400 in the same manner with the first embodiment.

Third Step

Finally, the release member 208*a* is fixed with the support member 208*b*. That is, the release member 208*a* is fixed with the support member 208*b* by welding in a third step in the same manner with the first embodiment. At this time, the straight portion 208*e* is brought into the state of abutting with the first abutment pins 400*a* and 400*b* by urging the release member 208*a* by the first compression springs 400*h*-2 and 400*j*-2. Still further, the positioning portions 208*b-c*-1 is brought into the state of abutting with the second abutment pins 400*c* and 400*d* by urging the support member 208*b* by the second compression springs 400*e*-2 and 400*f*-2.

In a case of the present embodiment as described above, as compared with the first embodiment, it is not necessary to consider the component tolerance in the X1 direction of the round hole 108*a-a* and the oblong hole 108*a-b* of the release member 108*a* of the first embodiment. Therefore, this arrangement makes it possible to reduce the component tolerance of a distance L2 in the X1 direction between the front end portion 208*a*-1 of the release member 208*a* and the positioning portion 208*b-c*-1 which is the abutment surface with the fixing flange 104 more than the first embodiment.

Note that while the fifth opening which is defined through the support member 208*b* is the notch 208*c* in the above description, the fifth opening may be an oblong hole which is oblong in the X1 direction. Still further, while one member through which the fifth opening is defined is the support member 208*b* and the other member through which the sixth opening is defined is the release member 208*a* in the above description, such relationships may be reversed. That is, the release member may be one member through which the fifth opening is defined, and the support member may be the other member through which the sixth opening is defied.

Other Embodiment

While the first through sixth openings described above are through holes or notches, they may be concave portions or grooves as long as the shafts of the jig can be inserted through. However, among the components of the release member and the support member, the components positioned on the jig side, depending on the installation state to the jig, are through holes and notches.

Still further, while the release member has been fixed with the support member by welding in the respective embodiments described above, they may be fixed by using other fixing methods such as bonding, screws, bolt and nut and rivets for example.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-032044, filed Feb. 25, 2019, which is hereby incorporated by reference herein in its entirety.

What is claimed is:

1. A release sheet unit configured to release a recording material from a surface of a fixing belt that fixes a toner image borne on the recording material onto the recording material by heating the toner image, the release sheet unit comprising:

a support member comprising a positioning portion formed on a part, in a first direction along a longitudinal direction of the support member, of the support member and configured to position the support member to a holding portion, that holds the fixing belt, in a second direction orthogonal to the first direction; and a release member fixed with the support member and comprising a front end portion that faces a surface of the fixing belt through a gap, wherein one member among the support member and the release member comprises a first opening which is oblong in the second direction more than the first direction in order to adjust a distance between the front end portion and the positioning portion in the second direction, wherein another member among the support member and the release member comprises a second opening, which is shorter in the second direction more than the first opening, at a position where at least part of the second opening overlaps with the first opening in a state in which the release member is fixed with the support member to adjust the distance between the front end portion and the positioning portion in the second direction, wherein the one member comprises a third opening which is oblong in the first direction more than the first opening in order to adjust the distance between the front end portion to the positioning portion in terms of the second direction, and wherein the another member comprises a fourth opening which is oblong in the first direction more than the second opening at a position where at least part of the fourth opening overlaps with the third opening in a state in which the release member is fixed with the support member in order to adjust the distance between the front end portion and the positioning portion in the second direction.

2. The release sheet unit according to claim 1, wherein the first and third openings are notches respectively opened to an end portion, in the second direction, of the one member.

3. A release sheet unit configured to release a recording material from a surface of a fixing belt that fixes a toner image borne on the recording material onto the recording material by heating the toner image, the release sheet unit comprising:

a support member comprising a positioning portion formed on a part, in a first direction along a longitudinal direction of the support member, of the support member and configured to position the support member to a holding portion, that holds the fixing belt, in a second direction orthogonal to the first direction; and a release member fixed with the support member and comprising a front end portion that faces a surface of the fixing belt through a gap, wherein one member among the support member and the release member comprises a first opening which is oblong in the second direction more than the first direction in order to adjust a distance between the front end portion and the positioning portion in the second direction, wherein another member among the support member and the release member comprises a second opening which is oblong in the second direction more than the first direction at a position where at least part of the second opening overlaps with the first opening in a state in which the release member is fixed with the support member in order to adjust the distance between the front end portion and the positioning portion in the second direction, wherein the first opening is a notch opened to an end portion, in the second direction, of the one member, and wherein the second opening is an oblong hole that does not reach an end portion, in the second direction, of the another member.

4. The release sheet unit according to claim 3, wherein the first opening is defined approximately at center of the one member in the first direction.

5. The release sheet unit according to claim 3, wherein the front end portion of the release member comprises an inverse crown portion where a center part in the first direction is concaved more than both end portions in a direction of separating away from the surface of the fixing belt in a state in which the front end portion of the release member faces the surface of the fixing belt, and a straight portion approximately in parallel with the first direction on both end sides in the first direction of the inverse crown portion.

6. The release sheet unit according to claim 1, wherein the one member is the support member and the another member is the release member.

7. A fixing unit comprising:

a fixing belt configured to come into contact with a recording material and to fix a toner image borne on a recording material to the recording material by heating the toner image;

a holding portion configured to hold the fixing belt; and the release sheet unit as set forth in claim 1 configured to release the recording material from a surface of the fixing belt.

8. A manufacturing method of a release sheet unit configured to release a recording material from a surface of a fixing belt that fixes a toner image borne on the recording material to the recording material by heating the toner image, the method comprising:

preparing a support member and a release member to be fixed with the support member, the support member comprising:

a positioning portion formed on a part, in a first direction along a longitudinal direction of the support member, of the support member and configured to position the support member to a holding portion that holds the fixing belt in a second direction orthogonal to the first direction, and a first opening which is oblong in the second direction more than the first direction, the release member comprising:

a front end portion that faces a surface of the fixing belt through a gap, and a second opening which is short in the second direction more than the first opening and which is disposed at a position where at least part of the second opening overlaps with the first opening in a state in which the release member is fixed with the support member;

installing the support member to a jig such that a shaft is inserted through the first opening, the jig comprising a shaft positioning the release member in the second direction by being inserted through the second opening, an abutment portion configured to abut with the positioning portion and an urging portion configured to urge the support member in the second direction such that the positioning portion abuts with the abutment portion;

installing the release member to the jig on which the support member has been installed such that the shaft is inserted through the second opening; and fitting the shaft into the first opening and fixing the release member with the support member in a state in which the positioning portion abuts with the abutment portion by urging the support member by the urging portion.

9. A manufacturing method of a release sheet unit for releasing a recording material from a surface of a fixing belt configured to fix a toner image borne on the recording material to the recording material by heating the toner image, the method comprising:

preparing a support member and a release member to be fixed with the support member, the support member comprising:

a positioning portion formed on a part, in a first direction along a longitudinal direction of the fixing belt, of the support member and configured to position the support member to a holding portion that holds the fixing belt in a second direction orthogonal to the first direction, and a first opening which is oblong in the second direction more than the first direction, the release member comprising:

a front end portion that faces a surface of the fixing belt through a gap, and a second opening which is oblong in the second direction more than the first direction at a position where at least part of the second opening overlaps with the first opening in a state in which the release member is fixed with the support member;

installing the support member to a jig such that a shaft is inserted through the first opening, the jig comprising the shaft inserted through the first and second openings, a first abutment portion configured to abut with a part of the front end portion, a second abutment portion configured to abut with the positioning portion, a first urging portion configured to urge the release member in the second direction such that part of a front end portion abuts with the first abutment portion and a second urging portion configured to urge the support member in the second direction such that the positioning portion abuts with the abutment portion;

installing the release member to the jig on which the support member has been installed such that the shaft is inserted through the second opening; and fitting the shaft into the first opening and fixing the release member with the support member in a state in which the part of a front end portion abuts with the first abutment portion by urging the release member by the first urging portion and the positioning portion abuts with the second abutment portion by urging the support member by the second urging portion.

10. The manufacturing method of the release sheet unit according to claim 8, wherein the release member is fixed with the support member by welding.

11. The manufacturing method of the release sheet unit according to claim 9, wherein the release member is fixed with the support member by welding.

12. The manufacturing method of the release sheet unit according to claim 8, wherein the release member comprises a third opening whose length in the second direction is substantially same as a length in the second direction of the first opening and whose length in the first direction is longer than a length in the first direction of the first opening, wherein the support member comprises a fourth opening bigger than the third opening, wherein the jig comprises another shaft with which the third opening is engaged, and wherein the shaft is fitted into the first opening, the another shaft is fitted into the third opening and the release member is fixed with the support member in a state in which the positioning portion abuts with the abutment portion by urging the support member by the urging portion.

13. The manufacturing method of the release sheet unit according to claim 9, wherein the release member comprises a third opening whose length in the second direction is substantially same as a length in the second direction of the first opening and whose length in the first direction is longer than a length in the first direction of the first opening, wherein the support member comprises a fourth opening bigger than the third opening, wherein the jig comprises another shaft with which the third opening is engaged, and wherein the shaft is fitted into the first opening, the another shaft is fitted into the third opening and the release member is fixed with the support member in a state in which the positioning portion abuts with the abutment portion by urging the support member by the urging portion.

* * * * *